US006581654B1

(12) United States Patent
Goldie et al.

(10) Patent No.: US 6,581,654 B1
(45) Date of Patent: Jun. 24, 2003

(54) PNEUMATIC CONTROL UNIT FOR LIQUID PRODUCT FILLING HEAD

(75) Inventors: Paul Goldie, Halifax, MA (US); Scot LaMar, Hawthorne, FL (US)

(73) Assignee: HealthStar, Inc., Randolph, MA (US)

( * ) Notice: Subject to any disclaimer, the term of this patent is extended or adjusted under 35 U.S.C. 154(b) by 33 days.

(21) Appl. No.: 10/017,758

(22) Filed: Dec. 14, 2001

(51) Int. Cl.[7] ..... B65B 3/26

(52) U.S. Cl. ..... 141/285; 141/40; 141/46; 141/198

(58) Field of Search ..... 141/5, 6, 85, 89–92, 141/39–41, 44–64, 95, 198, 285, 288, 301, 302, 307–309

(56) References Cited

U.S. PATENT DOCUMENTS 3,783,913 A * 1/1974 Trusselle ..... 141/46
5,161,586 A * 11/1992 Auriemma ..... 141/46

* cited by examiner

*Primary Examiner*—Gregory Huson
*Assistant Examiner*—Peter deVore
(74) *Attorney, Agent, or Firm*—Morse, Altman & Martin

(57) ABSTRACT

A pneumatic control head for controlling the supply of a product into a container via a filling head. A manifold has a pilot air duct. A start valve outputs main air to the pilot air duct when actuated by a mechanical switch. A pilot valve activates a cylinder using the main air in response to air pressure in the pilot air duct. A filling head source valve routs either sensing air or blow down air to a filling head output in response to the condition of a blow down valve actuated by a mechanical switch. An overpressure valve exhausts the pilot air duct in response to the sensing air having a pressure higher than normal. The switches each includes a ball bearing captured by a collar. An external cam pushes the ball bearing into the collar, causing the ball bearing to actuate the respective valve. Duct connections to valves are implemented by a single machined plate with a depression that overlaps the duct aperture and valve opening. An o-ring fits into a groove surrounding the depression and valve opening and provides a seal between the plate and the manifold.

4 Claims, 6 Drawing Sheets

PNEUMATIC CONTROL UNIT FOR LIQUID PRODUCT FILLING HEAD

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to liquid product filling heads, more particularly, to a pneumatic control unit for automatically shutting off a liquid product filling head filling a container upon sensing that the container is full.

2. Description of the Related Art

There are a number of automatic container filling machines in the art wherein a sensing tube extends into a container to be filled and when the lower end of the tube is blocked by the product in the container, back pressure through the tube actuates a control device to stop the flow of product into the container. In particular, U.S. Pat. No. 5,161,586 discloses a pneumatic control unit that responds to a sensed back pressure to shut off liquid to the filling container. The shortcomings of the disclosed design are discussed in detail below relative to the present invention.

BRIEF SUMMARY OF THE INVENTION

An object of the present invention is to provide a pneumatic control unit for a liquid filling head that is easier and less expensive to manufacture and that is easier to maintain than pneumatic control units of the prior art.

The present invention is a pneumatic control head for controlling the supply of a product into a container via a filling head with a sensing tube that extends into the container. The control head has a manifold with several air inputs. A main air input receives main air at an operating pressure, typically at about 60 psi. A blow down air input receives blow down air for cleaning the filling head as needed. A filling head output connects to the sensing tube. A cylinder for operating the filling head attaches to the manifold.

The majority of the control unit is built in a manifold. The manifold has a pilot air duct for conducting pilot air at a pressure near that of the main air operating pressure. A start valve takes in the main air and outputs it to the pilot air duct when actuated by a mechanical switch. The switch includes a ball bearing captured by a collar whereby the switch is actuated when the ball bearing is pressed into the collar.

A pilot valve in the manifold takes in the main air and allows it into a cylinder air duct to activate the cylinder in response to air pressure in the pilot air duct. Optionally, there is a no container switch that exhausts air from the pilot air duct in the event that there is no container under the filling head.

A flow regulator mounted to the manifold receives sensing air and outputs regulated sensing air at a sensing pressure. Optionally, a sensing air shut off valve precedes the flow regulator. The sensing air shut off valve is controlled by the main air to the cylinder so that if the cylinder is not actuated, there is no sensing air to cause the filling product to bubble.

The regulated sensing air passes through a filling head source valve to a filling head output. Normally the filling head source valve routs the regulated sensing air to the filling head output. The filling head source valve routs blow-down air to the filling head output in response to main air from a blow down valve. The blow down valve takes in the main air and outputs it to a switch the filling head source valve when actuated by a mechanical switch. The switch is of the same design as that of the start valve.

An overpressure valve mounted to the manifold exhausts the pilot air duct in response to the regulated sensing air having a pressure higher than normal. When the product fills the container to the point that the product nearly contacts the sensing tube, a back pressure is created that causes the overpressure sensor valve to trip.

Physically, the control unit includes a manifold within which are cut holes for valves and channels for ducts. A top plate houses the flow regulator and provides a mount for the overpressure sensor valve.

The start and blow down valve switches are improvements over those of the control units of the prior art. Each switch is a ball bearing captured by a collar. An external cam pushes the ball bearing into the collar, causing the ball bearing to push the start valve. Friction is reduced because the ball bearing rotates within the collar as the cam slides by. The improvement includes significantly fewer moving parts that substantially reduces both the initial manufacturing and the periodic maintenance costs.

Another improvement over the prior art is the means by which two of the ducts are routed to their respective valves. The pilot and filling head source valves fit into openings in the manifold. The appropriate duct exits at an aperture adjacent to the valve. A single machined plate has a depression that overlaps the aperture and the valve opening. An o-ring fits into a groove surrounding the depression and valve opening. The o-ring provides a seal between the plate and the manifold when installed.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
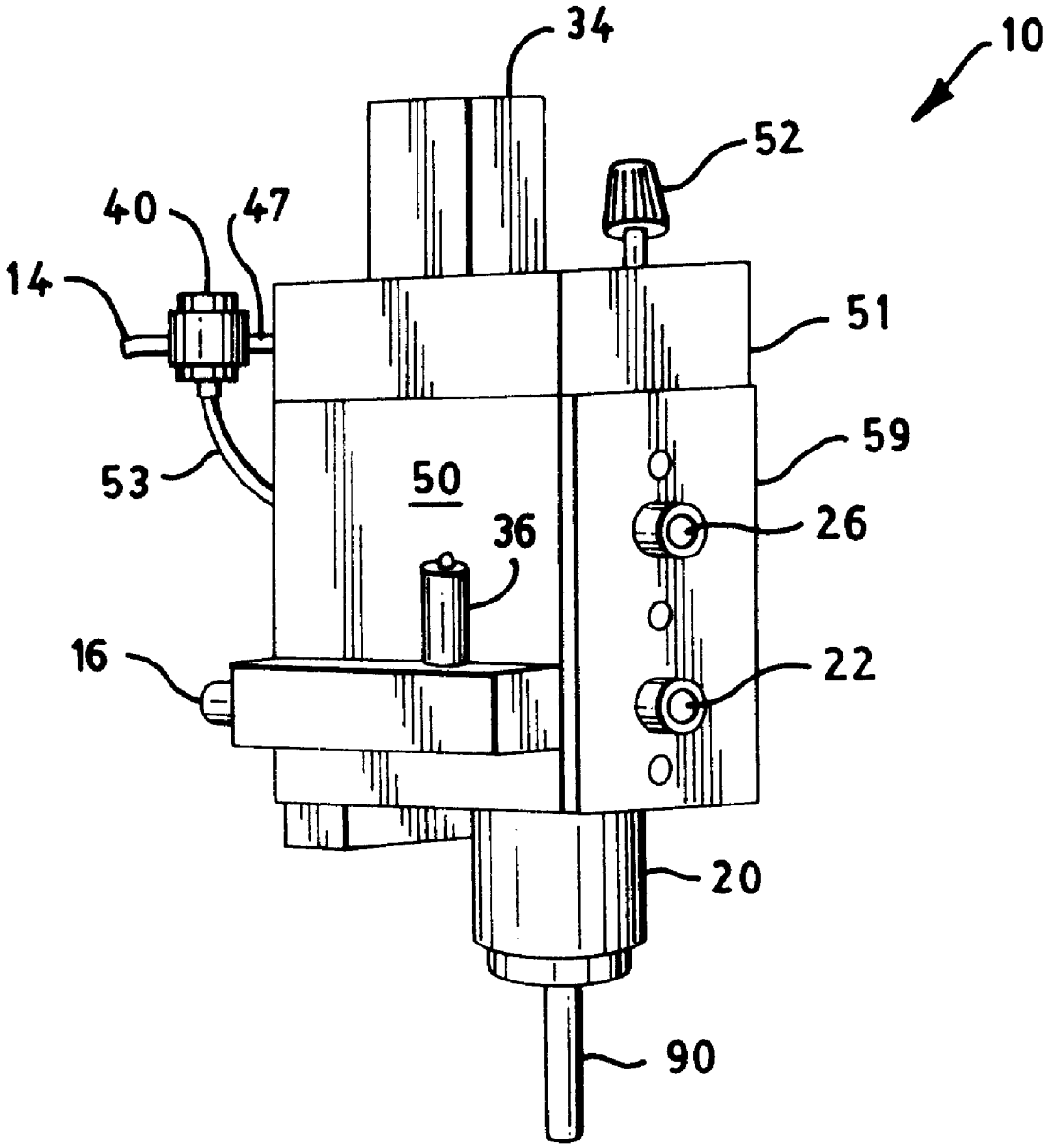
FIG. 1 is an front perspective view of the pneumatic control unit of the present invention.
Figure 2:
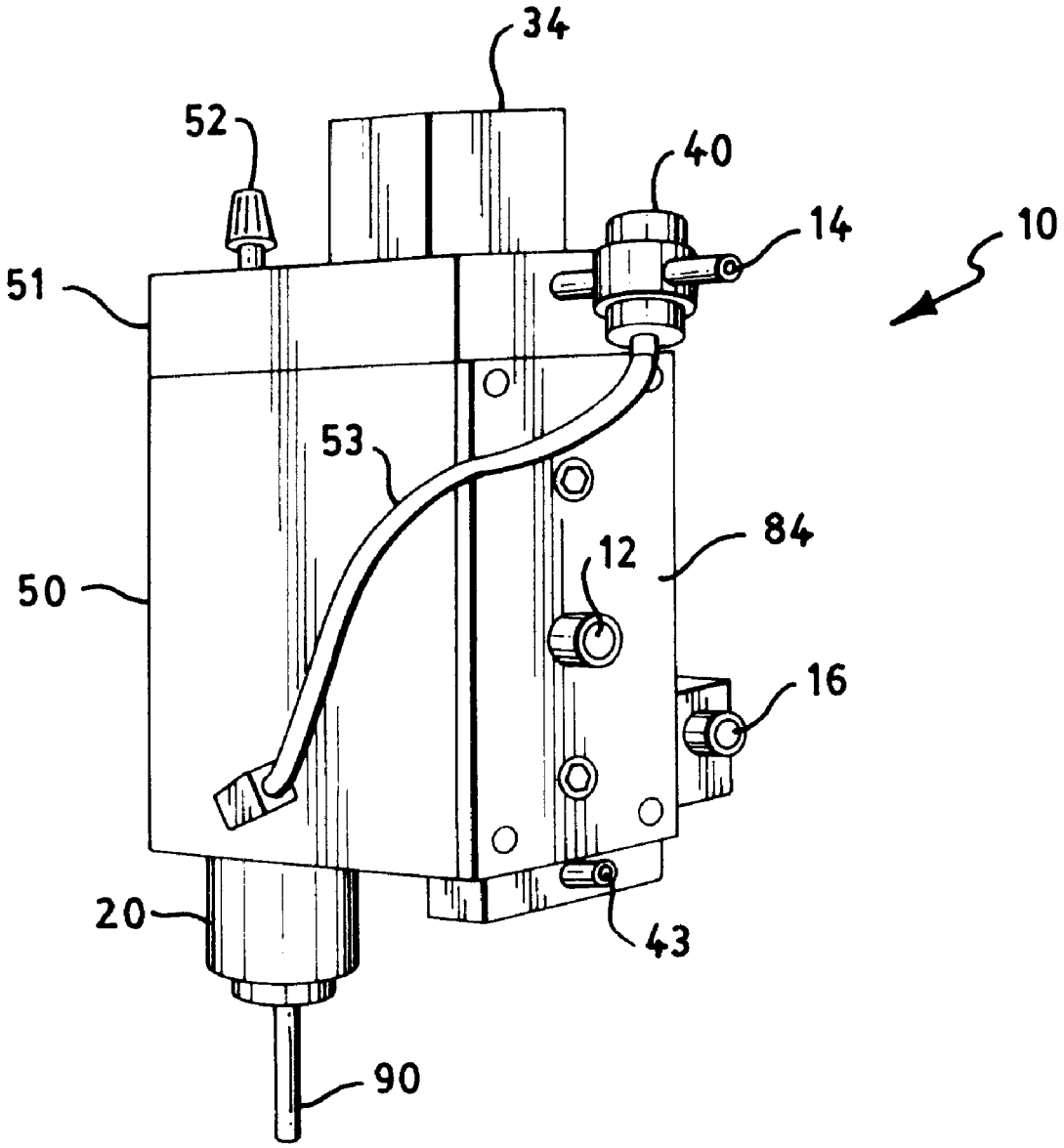
FIG. 2 is a rear perspective view of the pneumatic control unit of the present invention.
Figure 3:
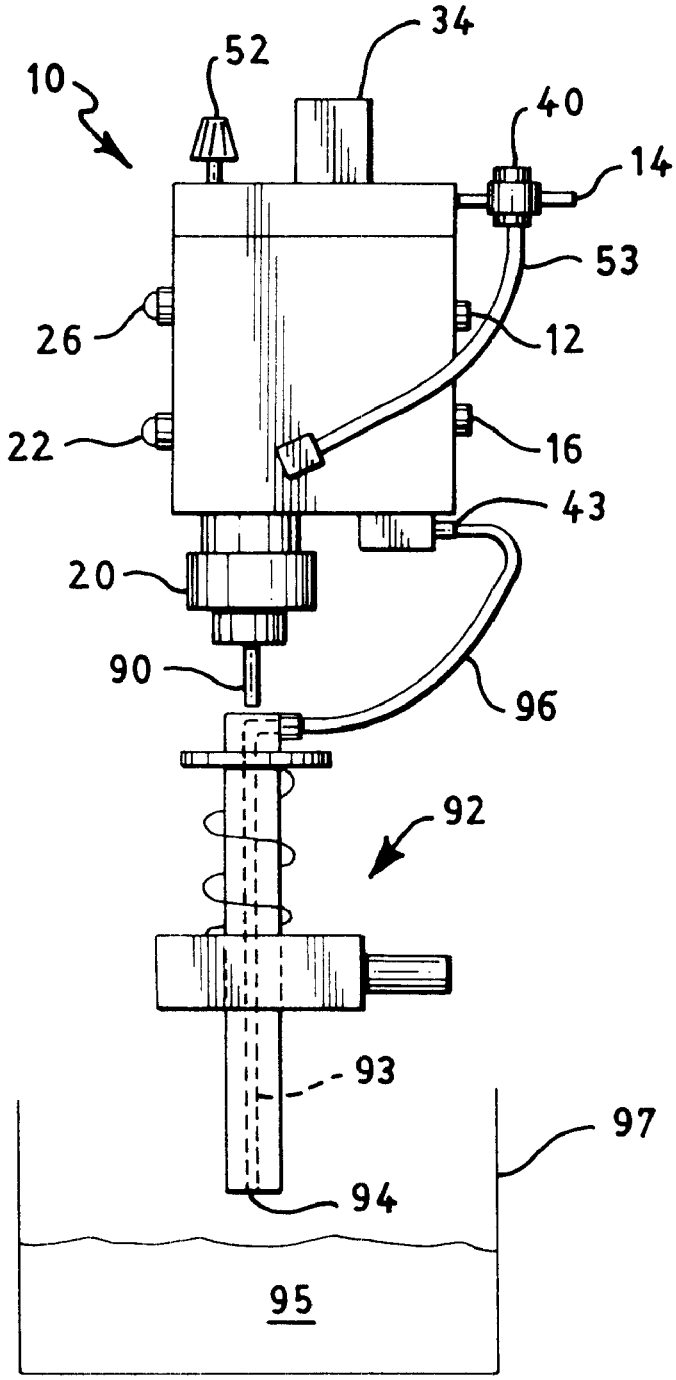
FIG. 3 is a side view of an assembly of the control unit of the present invention and a filling head.
Figure 4:
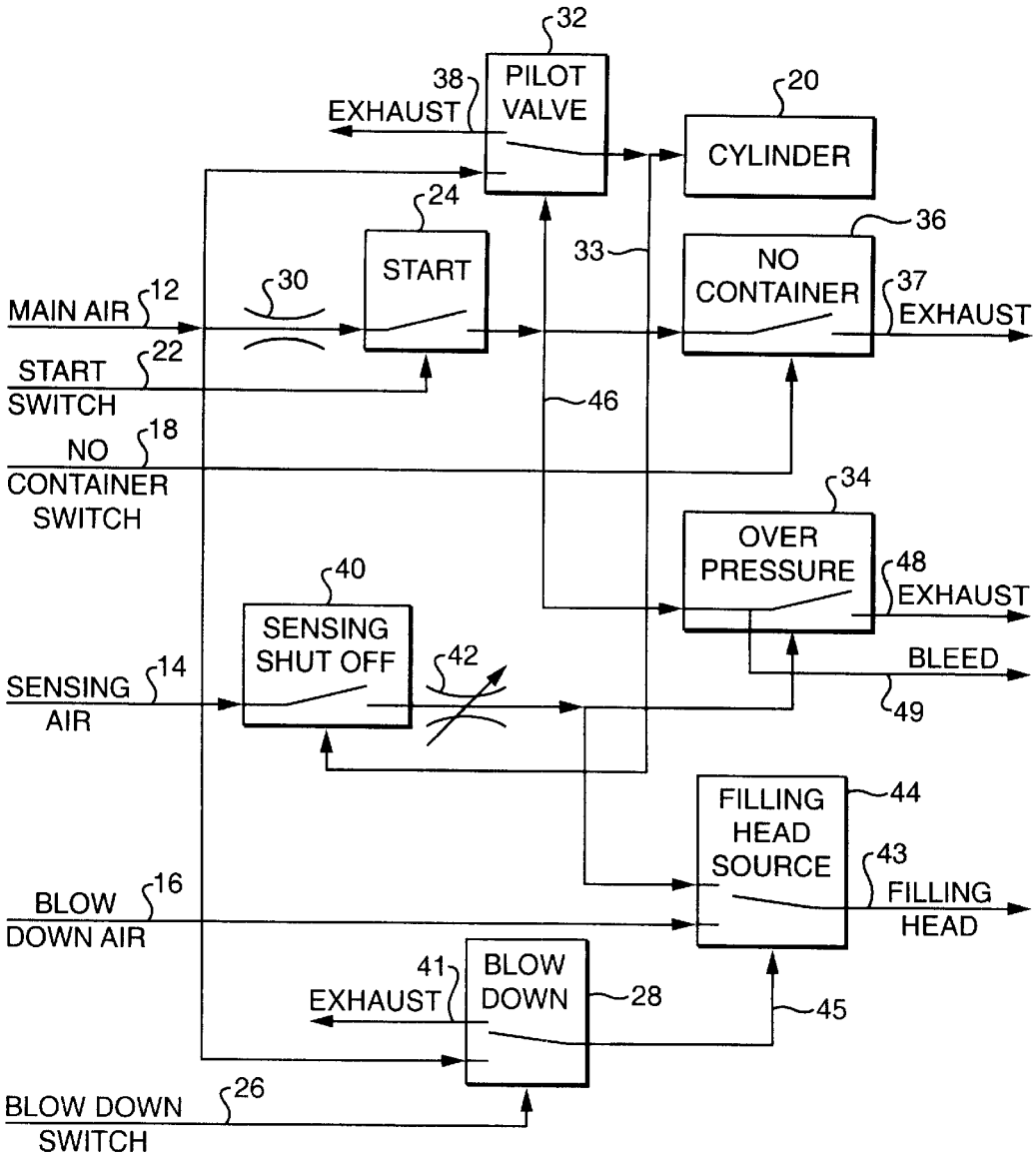
FIG. 4 is a schematic diagram of the control unit of the present invention.

The pneumatic control unit 10 of the present invention, shown in FIGS. 1–3 and schematically in FIG. 4, has three inlets for external air supplies. The main air inlet 12 accepts the main control air, typically at a pressure of about 60 psi.

The sensing air inlet 14 accepts the sensing air, typically at a pressure of about 5 psi This pressure is chosen to be low to avoid bubbling the liquid 95 in the top of a container 97 being filled while being high enough to reliably build a back pressure when the liquid 95 fills the container 97. The blow down air inlet 16 accepts the blow down air at a pressure typically in the range of about 20–40 psi. The purpose of the blow down air is to clean the filling head 96 as needed, so the pressure is set accordingly for the thickness of the filling liquid.

The air cylinder 20 for operating the filling head extends from the bottom of the control unit 10. The air cylinder piston 90 extends downwardly under controlled air pressure to open the filling head 94.

Refer now to FIG. 4. The start switch 22 mechanically actuates a start valve 24. The start valve 24 receives the main air and is normally closed, blocking the main air from the pilot air duct 46. When actuated, the start valve 24 opens, permitting the main air into the pilot air duct 46. The air in the pilot air duct 46 is referred to as the pilot air. The high pressure pilot air is routed into a no container safety valve 36 of well-known design. Essentially, when there is no container to fill, a mechanical switch 18 actuates the no container safety valve 36, which exhausts the pilot air from the pilot air duct 46, as at 37, preventing it from causing the actuation of the air cylinder 20. A flow restrictor 30 prevents an excess of main air pressure from exceeding the capacity of the no container safety valve 36.

The pilot air is routed to a pilot valve 32 and to an overpressure sensor valve 34. When the start switch 22 is actuated, the pilot air actuates the pilot valve 32 thereby permitting the main air into a cylinder air duct 33, actuating the air cylinder 20. Preferably, the pilot valve 32 has a compensating orifice which opens into a passageway into the pilot air chamber of the pilot valve 32. When the pilot valve 32 is actuated, a portion of the main air passes through the compensating orifice into the pilot air chamber to help hold the pilot valve 32 actuated in order to compensate for any pilot system leaks. For example, some air is bled out of the pilot air duct 46 through a small bleed orifice in the overpressure sensor valve 34, as described below. A drop in the pilot air pressure will deactuate the pilot valve 32. Once closing begins, the air from the cylinder air duct 33 is exhausted through the pilot valve exhaust port 38. In this way the pilot valve 32 reacts quickly to a drop in pilot pressure to stop the liquid filling operation.

The overpressure sensor valve 34 quickly triggers the shut off of the liquid filling operation in response to back pressure from the container 97 being filled. The sensing air is applied to a diaphragm and is allowed to escape through a bleed orifice 49. When the pressure on the diaphragm increases such that the diaphragm flexes, the flexing diaphragm covers the bleed orifice 49, causing a build up of pressure which triggers the valve 34 to open. When the overpressure sensor valve 34 opens, the pilot air is exhausted out through the valve 34, as at 48, causing the air cylinder piston 90 to retract, halting the liquid filling operation.

The sensing air inlet 14 provides the sensing air control signal to the overpressure sensor valve 34. Optionally, the sensing air is routed through a sensing air shutoff valve 40 that is controlled by the main air to the cylinder 20. By shutting off the sensing air when the fill is complete, bubbling of the filling liquid by the sensing air is avoided.

A flow regulator 42 permits accurate regulation of the pressure of the sensing air, providing a means to adjust the control unit 10 for the height of the liquid fill. If the flow regulator 42 is of a variable type, two or more control units 10 may be employed in a mass production filling machine by adjusting the sensing air to fill all containers to the same height.

The sensing air from the flow regulator 42 passes through a filling head source valve 44 to a filling head output 43. The normal state of the filling head source valve 44 routs the sensing air to the filling head output 43. The switched state of the filling head source valve 44 routs blow-down air to the filling head output 43, as described below.

The filling head output 43 is connected, via a hose 96, to a sensing tube 93 at the end of the filling head 92. The sensing air easily passes out of the sensing tube opening 94 until the filling liquid 95 contacts or nearly contacts the opening 94. When this occurs, a back pressure is created that causes the overpressure sensor valve 34 to trip, shutting off the filling operation.

The blow down operation clears the sensing tube 93. A blow down switch 26 mechanically actuates the blow down valve 28, allowing main air into a filling head source control duct 45, which directs the filling head source valve 44 to rout the blow down air from the blow down air inlet 16 to the filling head output 43. The blow down-operation is momentary, that is, it only operates as long as the blow down switch 26 is activated. When the blow down switch is not actuated, the main air is exhausted from the filling head source control duct 45 by the blow down valve 28, as at 41.

The majority of the control unit 10 is formed in a manifold 50, preferably a block of aluminum. Holes are drilled and channels are cut in the manifold 50 to accommodate the valves and to form the passages between those valves, all in a manner well-known in the art.

A top plate 51 is mounted to the top of the manifold 50. The top plate 51 provides a housing for the flow regulator 42 and a connection to the manifold 50 for the overpressure sensor valve 34. The flow regulator control knob 52 extends vertically from the top of the top plate 51. The sensing air shutoff valve 40 extends rearwardly from the top plate 51. It receives its connection to the pilot air duct 33 by a hose 53 from the manifold 50. The output 43 of the filling head source valve 44 is located on the bottom of the manifold 50 and is connected to the filling head 92 by a hose 96.

The start valve 24 and blow down valve 28 are located on the same side of the manifold 50. In the prior art, the start switch 22 and blow down switch 26 are rather complicated mechanisms. The appropriate valve is actuated by a leaf spring that is pushed by a pivoting arm. At the free end of the arm is a roller that is pushed by an external cam. The reason for the roller is so that friction is kept to a minimum as the external cam slides by. The various moving parts require regular maintenance to keep operating properly.

Figure 5:
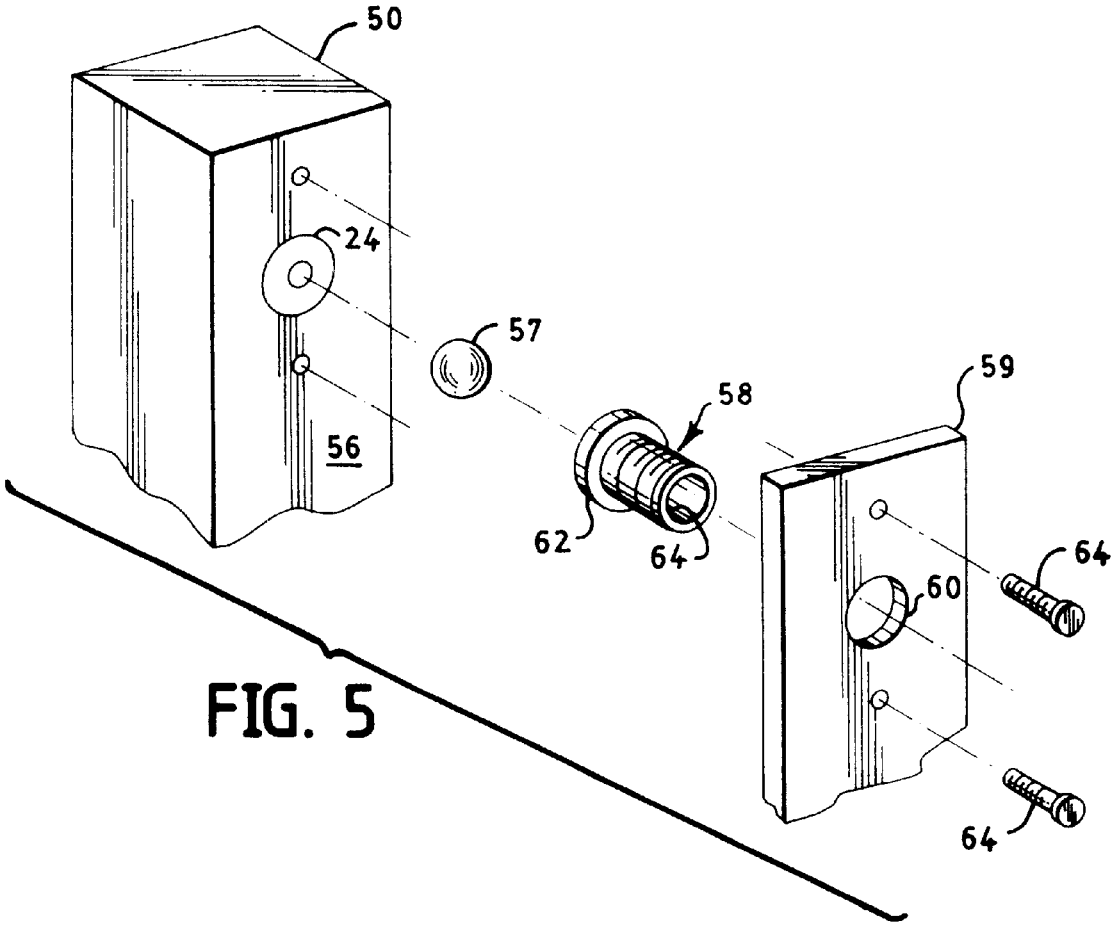
FIG. 5 is an exploded view of the start switch mechanism of the control unit of FIG. 1.

The present invention replaces each roller/arm mechanism with a simple ball bearing 57 inside a collar 58. As can be seen in FIG. 5, the front surface 56 of the manifold 50 is covered by a front plate 59. The front plate 59 includes a clearance hole 60 for the collar 58. The collar 58 is a short tube with a flange 62 at the inner end. The inside diameter of the tube is slightly larger than the ball bearing 57 so that the ball bearing 57 slides easily within the tube. An internal lip 64 at the outer end of the collar 58 as an inside diameter slightly smaller than the ball bearing 57 so that the ball bearing 57 is retained in the collar 58 when installed. The plate 59 is typically removably secured by screws 65 sandwiching the collar 58 by the flange 62 between the manifold front surface 56 and the front plate 59. The ball bearing 54 extends outwardly from the collar 58 at least the length of travel of the start valve 24. As the control unit 10 moves past the start cam, the cam pushes the ball bearing 57 into the collar 58, causing the ball bearing 57 to push the start valve 24, initiating the fill operation. Friction is reduced between the start switch 22 and the cam because the ball bearing 57 rotates within the collar 58 as the cam slides by. The blow down 26 switch is implemented in the same way.

The ball bearing design is an improvement over the design of the prior art. The numerous moving parts, including the roller, the arm, and the leaf spring, are replace by a single moving part, the ball bearing 57. The reduction in the number of parts substantially reduces both the initial manufacturing cost and the periodic maintenance cost of the control unit 10.

Figure 6:
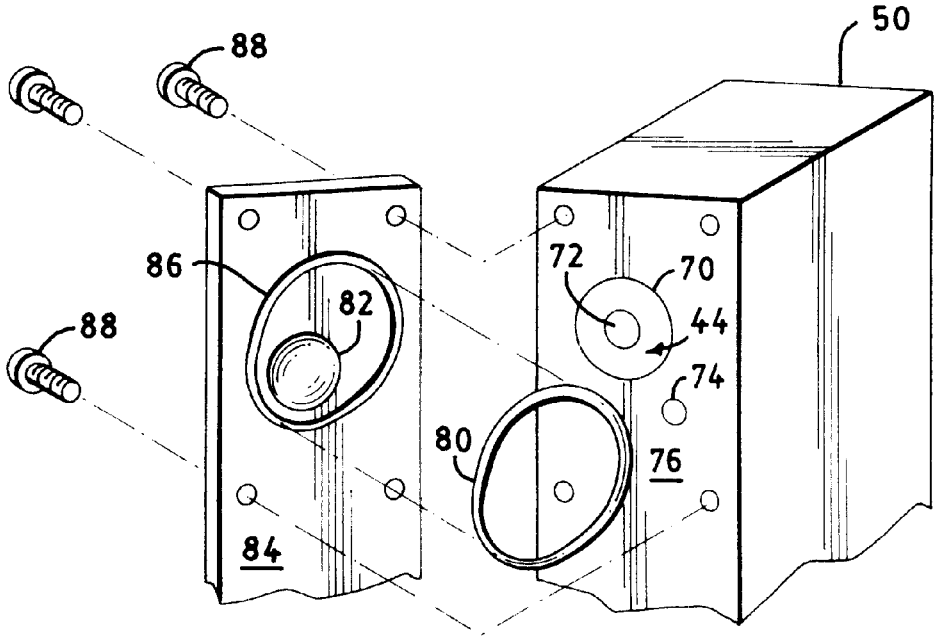
FIG. 6 is an exploded view of the pilot valve at the rear of the control unit of FIG. 2.

The rear of the control unit 10 is shown in FIGS. 2 and 6. As can be seen, the filling head source valve 44 fits into a cylindrical opening 70 in the manifold 50 leaving the actuator 72 free. The filling head source control duct 45 exits at an aperture 74 in the rear wall 76 and must be routed to the filling head source valve 44. The pilot valve 32 and the pilot air duct 46 have the same arrangement. In the prior art, a gasket with a groove fits over the rear wall of the manifold such that one end of the groove is positioned over the valve and the other end of the groove is positioned over the aperture. A metal plate is placed over the gasket and secured to the rear wall. The groove provides the connecting duct and the gasket prevents leaks. Since the rear of the control unit of the prior art has two valves and an air inlet, there are a number of components, including three plates, three gaskets, and a handful of screws, making the manifold relatively costly to manufacture and assemble.

The present invention replaces the piecemeal design of the prior art with the design of FIG. 6. The multiple plates and gaskets are replaced by a single machined plate 78 and o-rings 80. A depression 82 that overlaps both the aperture 74 and part of the valve opening 70 is machined in the surface 84 of the plate 78. The shape of the depression 82 is unimportant, as long as it overlaps both the aperture 74 and the valve opening 70. In the present embodiment, the depression 82 is cylindrical for ease in machining. A groove 86 surrounding the depression 82 and valve opening 70 is machined in the plate surface 84. An o-ring 80 seats in the groove 86 and provides a seal between the plate 78 and the manifold rear wall 76 when the plate 78 is secured to the rear wall 76, typically by screws 88. In the present embodiment, the groove 86 is eccentric because of the dimensions of the plate 78 and manifold 50. However, the shape of the groove 86 is unimportant as long as it provides a seat for the o-ring 80 as required. Since there are actually two valves and ducts that need to be connected, the control unit 10 of the present invention has two depressions 82, two grooves 86, and two 0-rings 80, one each for the pilot valve and the filling head source valve 44.

Thus it has been shown and described a pneumatic control unit which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A pneumatic control head for controlling the supply of a product into a container, said head adapted to be used with a filling head, said filling head having a sensing tube, said sensing tube having a sensing opening at the end thereof, said control head comprising:

(a) a manifold, said manifold having a main air input for receiving main air at an operating pressure, a blow down air input for receiving blow down air, and a filling head output, said filling head output being adapted to permit connection to said sensing tube of said filling head;

(b) a cylinder in said manifold, said cylinder having a piston adapted to operate said filling head;

(c) a pilot air duct within said manifold for conducting pilot air at a pressure near in magnitude to said operating pressure;

(d) a start valve in said manifold having a start switch accessible from a front surface of said manifold, an input for said main air, and an output at said pilot air duct, said start valve having a closed position wherein said main air is blocked from said pilot air duct and an open position wherein said main air is allowed into said pilot air duct, said start switch putting said start valve into said open position when actuated;

(e) a pilot valve in said manifold having an open position in response to high pressure pilot air in said pilot air duct wherein said main air is allowed into a cylinder air duct to activate said cylinder, and having a closed position in response to a drop in pressure in said pilot air duct wherein said main air is blocked from said cylinder air input and said cylinder air duct is exhausted;

(f) a flow regulator mounted to said manifold having an input for receiving sensing air and an output, said flow regulator providing regulated sensing air at a sensing pressure at said flow regulator output;

(g) a blow down valve in said manifold having a blow down switch accessible from said front surface of said manifold, an input for said main air, and an output at a filling head source control duct, said blow-down valve having an open position wherein said main air is allowed into said filling head source control duct and a closed position wherein said main air is exhausted from said filling head source control duct, said blow down switch putting said blow-down valve into said open position when actuated;

(h) a filling head source valve in said manifold having an input for said regulated sensing air, an input for said blow down air, and an output to said filling head output, said filling head source valve having a sensing position in response to a lack of said main air in said filling head source control duct wherein said sensing air is allowed to said filling head output and a blow down position in response to said main air in said filling head source control duct wherein said blow down air is allowed to said filling head output; and (i) an overpressure valve mounted to said manifold having a closed position in response to said regulated sensing air at said sensing pressure and an open position in response to said regulated sensing air at a pressure higher than said sensing pressure wherein said pilot air is exhausted from said pilot air duct;

(j) said start switch and said blow down switch each including a collar and ball bearing, said ball bearing being captured by said collar when said collar is installed in said manifold, whereby said switch is actuated when said ball bearing is pressed into said manifold.

2. The pneumatic control head of claim 1 wherein:

(a) said pilot valve and said filling head source valve are mounted in openings in a rear wall of said manifold;

(b) said pilot duct opens at a pilot duct aperture adjacent to said pilot valve and said filling head source control duct opens at a filling head source control duct aperture adjacent to said filling head source valve;

(c) a plate abutting said rear wall, said plate having a pair of depressions adjacent to said rear wall, a first of said depressions overlapping said pilot duct aperture and said pilot valve and a second of said depressions overlapping said filling head source control duct aperture and said filling head source valve;

(d) a first groove in said plate surrounding said pilot duct aperture and said pilot valve;

(e) a second groove in said plate surrounding said filling head source control duct aperture and said filling head source valve; and (f) o-rings in said grooves providing a seal between said rear wall and said plate when said plate is mounted to said rear wall.

3. The pneumatic control head of claim 1 wherein said sensing air passes through a sensing air control valve prior to said flow regulator input, said sensing air control valve having an open position in response to said main air in said cylinder air duct and a closed position in response to lack of main air in said cylinder air duct.

4. The pneumatic control head of claim 1 wherein said control head includes a no container sensor, said no container sensor having a closed position in response to the presence of a container and an open position in response to the lack of a container wherein said pilot air is exhausted from said pilot air duct.

* * * * *